US007828580B2

(12) United States Patent
Zhu et al.

(10) Patent No.: US 7,828,580 B2
(45) Date of Patent: Nov. 9, 2010

(54) ELECTRICAL CONNECTOR WITH BLOCKING PORTIONS FOR PREVENTING LATCHING ARMS FROM TILTING

(75) Inventors: Jian-Kuang Zhu, Kunshan (CN); Xiao-Gao Yang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 147 days.

(21) Appl. No.: 12/316,950

(22) Filed: Dec. 18, 2008

(65) Prior Publication Data

US 2009/0156047 A1 Jun. 18, 2009

(30) Foreign Application Priority Data

Dec. 18, 2007 (CN) ..... 2007 2 0131600 U

(51) Int. Cl.
*H01R 13/627* (2006.01)

(52) U.S. Cl. ..... 439/352; 439/326; 439/328

(58) Field of Classification Search ..... 439/352, 439/325–329, 92, 108, 64, 630, 79, 541.5, 439/629

See application file for complete search history.

(56) References Cited

U.S. PATENT DOCUMENTS 5,997,332 A * 12/1999 Choy ..... 439/328
6,042,411 A * 3/2000 Choy ..... 439/328
6,162,069 A * 12/2000 Choy ..... 439/92
6,319,035 B1 * 11/2001 Choy ..... 439/326
6,419,513 B1 * 7/2002 Choy ..... 439/326
2002/0082729 A1 6/2002 Tsao
2006/0094277 A1 * 5/2006 Yang et al. ..... 439/328

* cited by examiner

*Primary Examiner*—Edwin A. Leon
(74) *Attorney, Agent, or Firm*—Andrew C. Cheng; Wei Te Chung; Ming Chieh Chang

(57) ABSTRACT

An electrical connector (100) includes an insulative housing (1), a plurality of contacts (2) received in the housing and a pair of latching members (3) assembled on the housing. The insulative housing defines a longitudinal main body (10) with an inserted groove (101) extending along a longitudinal direction, a pair of latching arms (11) extending forwards from two opposite ends of the main body and a pair of sidewalls (12) respectively positioned outside of the latching arms, each sidewall defines a slot (121) therein. The latching members are assembled on the latching arms, each latching member is being attached to an outer side of a corresponding latching arm and defines a blocking portion (35) extending into the slot.

9 Claims, 4 Drawing Sheets

ELECTRICAL CONNECTOR WITH BLOCKING PORTIONS FOR PREVENTING LATCHING ARMS FROM TILTING

BACKGROUND OF THE INVENTION

1. Field of the Invention

The present invention relates to an electrical connector, and especially to a card edge connector that having blocking portions to prevent latching arms of the connector from tilting.

2. Description of the Related Art

US Pat. Publication No. 2002/0082729 A1 discloses a PC card connector assembly comprising a first connector and a second connector. The first connector includes a housing defining an elongated slot along a longitudinal direction thereof. A plurality of passageways are defined at two sides of the slot in the housing. A plurality of contacts are received within the corresponding passageways with contacting portions extending into the slot. A pair of L-shaped supporting portions extend forwards from two opposite ends of the housing, each with a latching arm extending forwards therefrom. A retaining member is retained on the latching arm with one end inserted into a slot defined between the supporting portion and the latching arm, and the other end clasped a front end of the latching arm. A soldering member is set under the supporting portion with one end inserted into a corresponding slot defined in the housing and the other end to be soldered on a PCB.

Users can slantways insert a front end of an electronic card into the elongated slot, then rotates the rear end of the card downwards to get an electronic connection between the connector and the electronic card. At that time, the two opposite side portions of the back portion of the card are respectively locked under a locking portion defined at the front end of each latching arm.

But the card may hustle the contacts and make the contacts deform, so that the contacts may give a fore to the card to make the rear end of the card have a upward tendency, and the rear end of the card may push the locking portions to make the latching arms further move upwards, which may destroy the latching arms and cause the card break off from the connector. Hence, a new design which can prevent the latching arms from tilting is required.

SUMMARY OF THE INVENTION

Accordingly, an object of the present invention is to provide an electrical connector with blocking portions for preventing latching arms from tilting.

In order to achieve the object set forth, an electrical connector includes an insulative housing, a plurality of contacts received in the housing and a pair of latching members assembled on the housing. The insulative housing defines a longitudinal main body with an inserted groove extending along a longitudinal direction, a pair of latching arms extending forwards from two opposite ends of the main body and a pair of sidewalls respectively positioned outside of the latching arms, each sidewall defines a slot therein. The latching members are assembled on the latching arms, each latching member is being attached to an outer side of a corresponding latching arm and defines a blocking portion extending into the slot.

Other objects, advantages and novel features of the invention will become more apparent from the following detailed description of the present embodiment when taken in conjunction with the accompanying drawings.

DETAILED DESCRIPTION OF THE INVENTION

Figure 1:
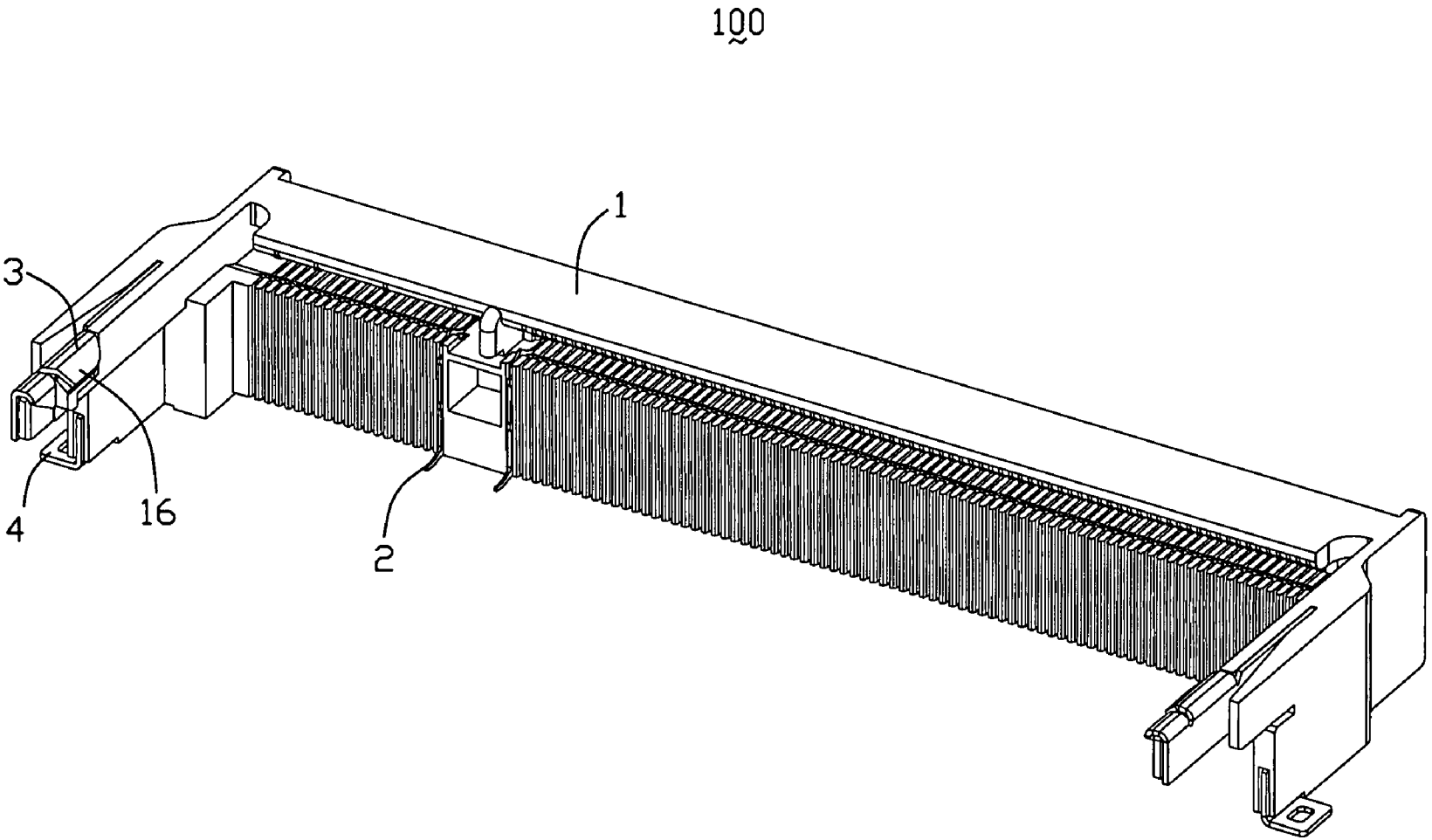
FIG. 1 is an assembled perspective view of an electrical connector in accordance with a preferred embodiment of the present invention.

Reference will now be made to the drawing figures to describe a preferred embodiment of the present invention in detail.

Referring to FIG. 1, an electrical connector 100 of the present invention mainly includes an insulative housing 1, a plurality of contacts 2 received in the housing 1, a pair of latching/reinforcement members 3 respectively disposed and detachably secured on two opposite ends of the insulative housing 1 and a pair of soldering members 4.

Figure 2:
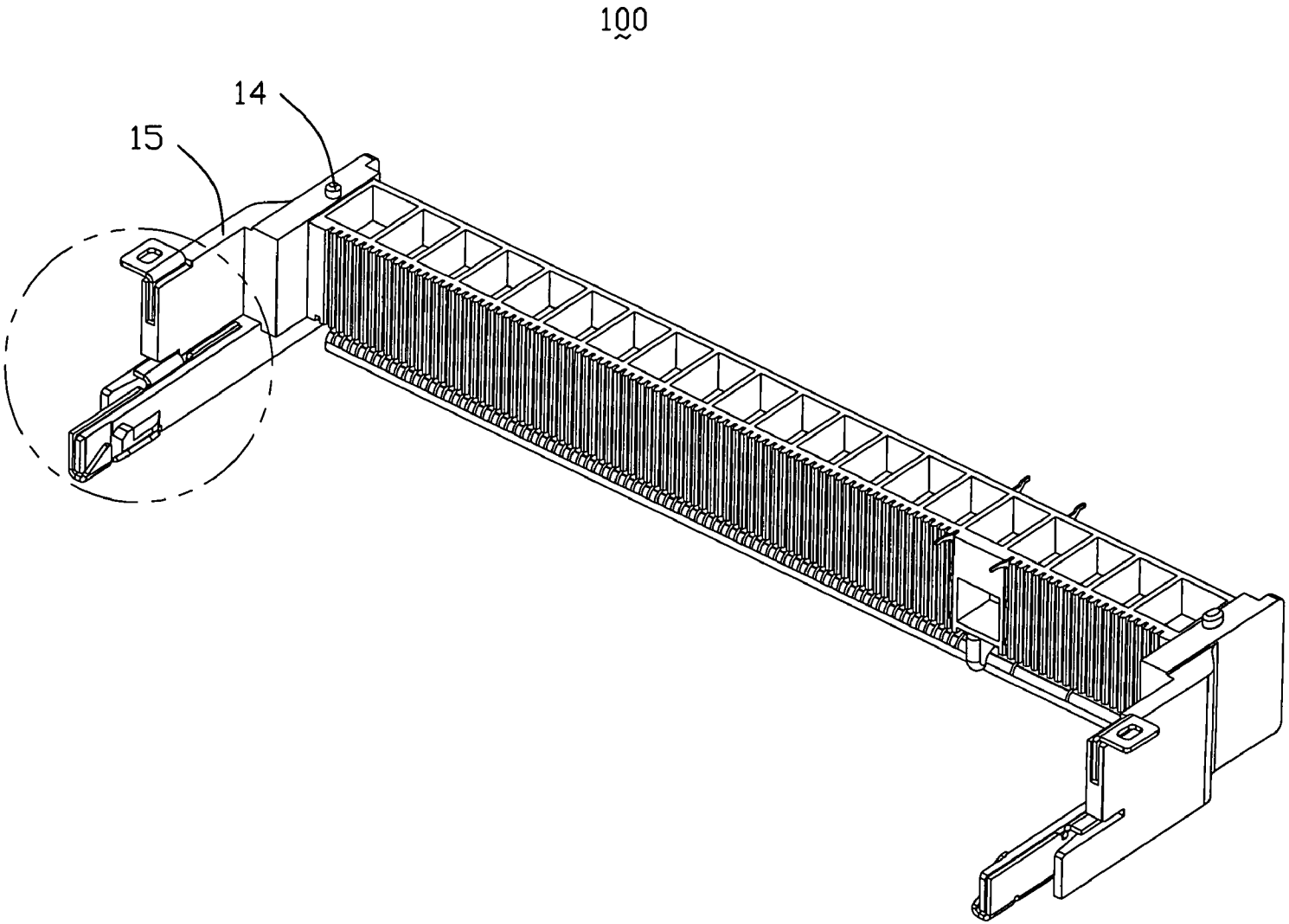
FIG. 2 is another view of the electrical connector shown in FIG. 1.
Figure 3:
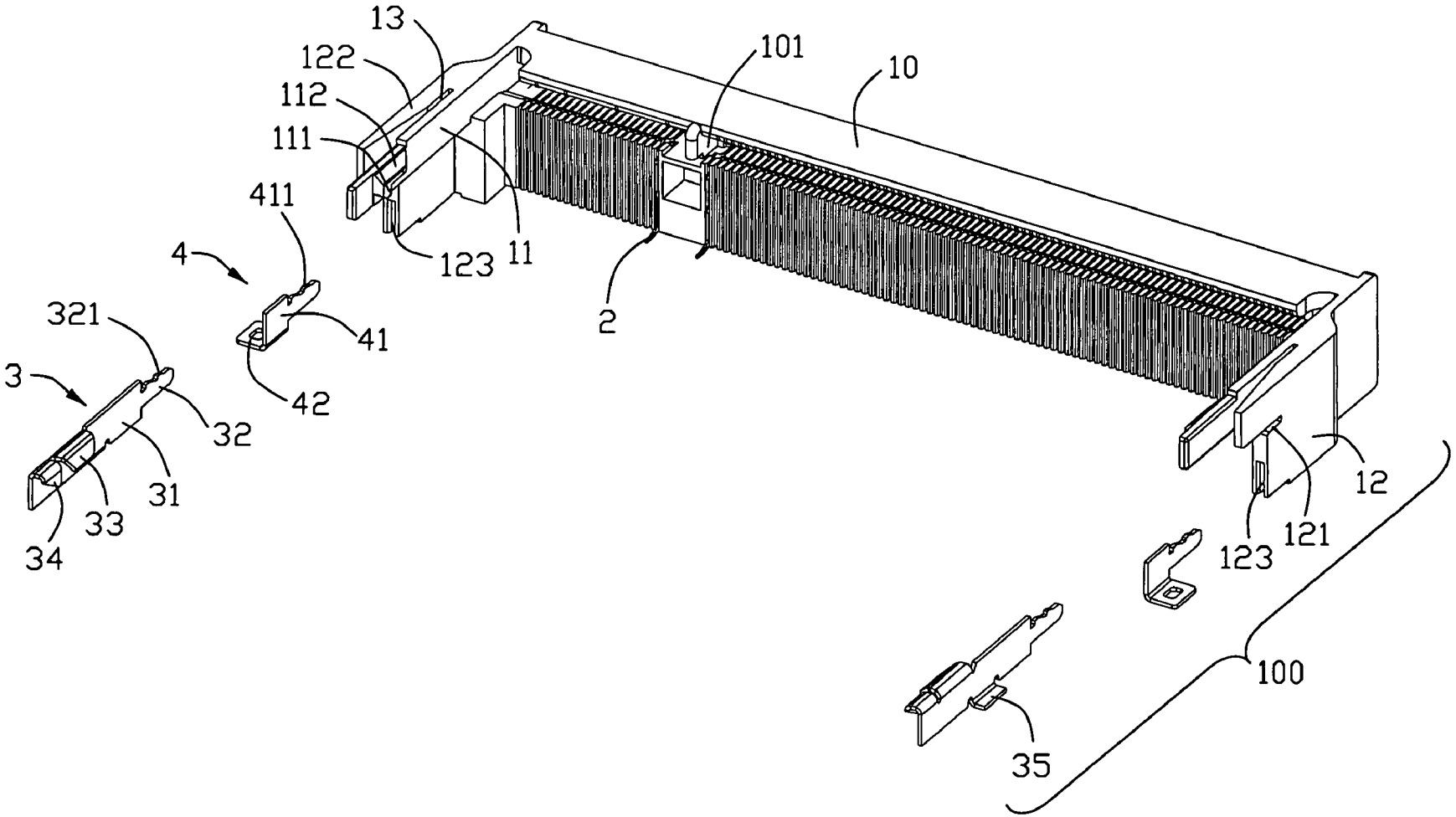
FIG. 3 is a partly exploded view of the electrical connector shown in FIG. 1.

Referring to FIG. 3, the insulative housing 1 defines a longitudinal main body 10 and a pair of elastic latching arms 11 projecting forwardly and integrally from two ends of the insulative housing 1. The main body 10 includes an inserted groove 101 along a longitudinal direction at a front face thereof for insertion of a connecting end of an electronic card. The inserted groove 101 of the main body 10 has an upper side wall and a lower side wall which are provided with a plurality of passages to receive the contacts 2 therein. The latching arms 11 each defines a locking portion 111 projecting to each other from the inner side thereof to block the electronic card, and each locking portion 111 defines a top face as a guiding surface 112. The housing 1 further defines a pair of sidewalls 12 respectively positioned outside of the latching arms 11, and each sidewall 12 defines a slot 121 running through the front end and the inner surface of the sidewall 12. The upper portion of the sidewall 12 that positioned above the slot 121 is defined as a blocking arm 122, which will block the latching arm 11 to prevent the latching arm 11 from further moving outwards and being destroyed. A receiving slot 13 is defined between the latching arm 11 and the blocking arm 122. The insulative housing 1 has a bottom face which is defined as a mounting face, having a pair of symmetrical post 14 (as FIG. 2 shown) projecting from the two ends thereof for positioning the electrical connector 100 to a circuit board.

Figure 4:
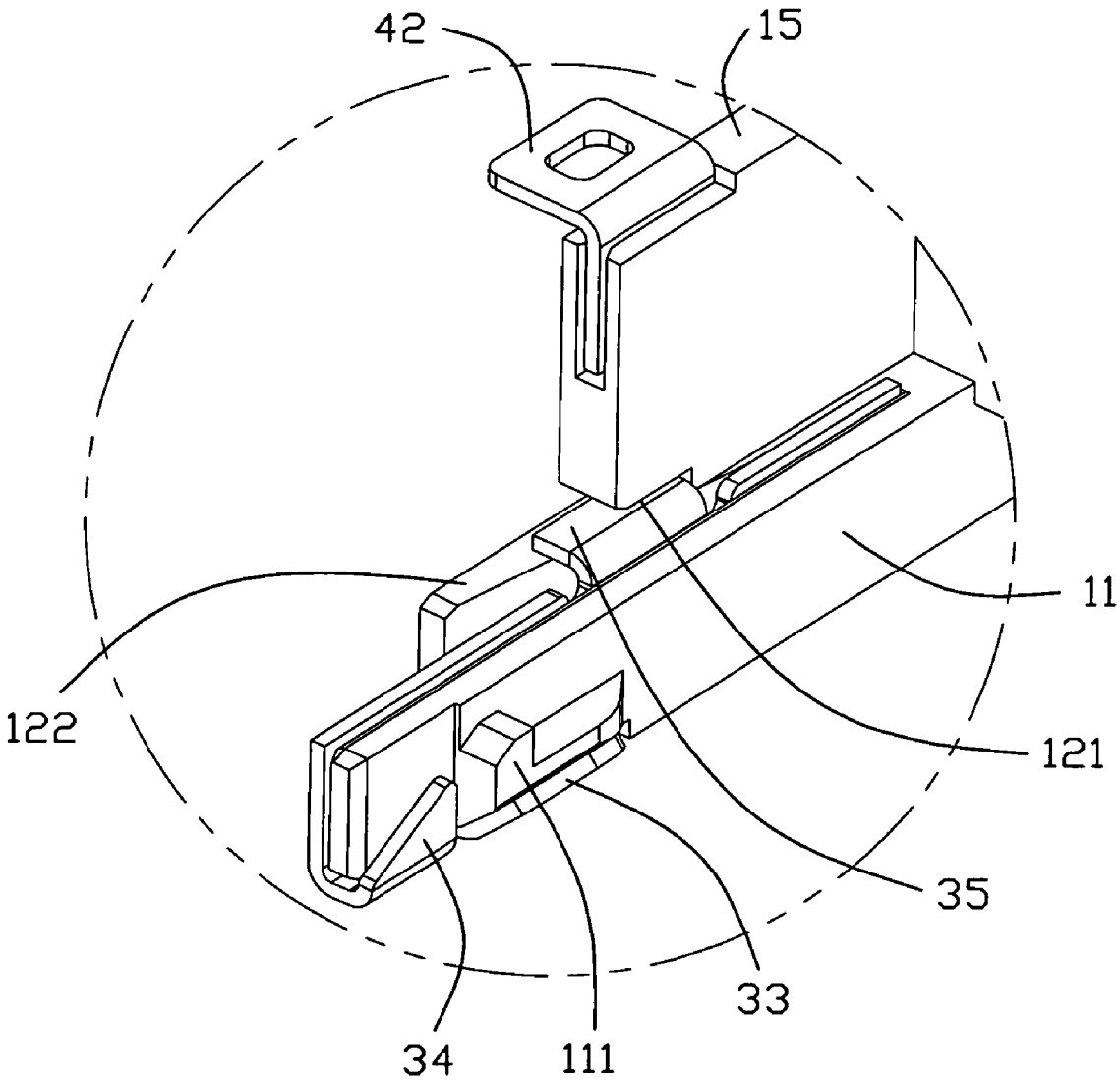
FIG. 4 is an amplificatory view of the part in the circle shown in FIG. 2.

Referring to FIG. 3 and FIG. 4, the latching members 3 are made from a metal sheet. Each latching member 3 includes a board shaped base portion 31, an insertion portion 32 extending from one end of the base portion 31, a guiding portion 33 extending from an upper edge of the base portion 31 and bending to the inner side for covering on the guiding surface 112, and a retaining portion 34 extending from the upper edge of the base portion 31 and in front of the guiding portion 33. A blocking portion 35 further extends from a lower edge opposite to the upper edge where the guiding portion 33 extending therefrom and bends outwards to the sidewall 12. The base portion 31 is wider than the insertion portion 32, and both of which are in a same plane. The latching member 3 is assembled on the latching arm 11 with the insertion portion 32 is inserted into the receiving slot 13, and the base portion 31 attaches to the outer side of the latching arm 11, the guiding portion 33 covers onto the guiding surface 112 to define a guiding member 16 (as FIG. 1 shown) to guide the card moving downwards smoothly. A plurality of barbs 321 project from the insertion portion 32 to engage with the receiving slot 13 and the retaining portion 34 hooks the front portion of the latching arm 11 both for retaining the latching member 3 in the latching arm 11 steadily. The blocking portion 35 runs into the slot 121 and is positioned under the blocking arm 122.

The soldering members 4 are also made from a metal sheet, and each soldering member 4 is separated from the latching member 3. Each soldering member 4 defines a board shaped fixing portion 41 and a soldering portion 42 bending from a lower edge of the fixing portion 41. The lower portion of the sidewall 12 that positioned under the slot 121 defines a receiving groove 123 thereof, the receiving groove 123 hollows from the front face and runs through the bottom face 15 of the sidewall 12. The soldering member 4 is retained in the lower portion of the sidewall 12 with the fixing portion 41 is inserted into the receiving groove 123, the barbs 411 projecting from the fixing portion 41 will engage with the receiving groove 123 to retained the soldering member 4 steadily. The soldering portion 42 extends out of the receiving groove 123 to be soldered to the circuit board.

When a front end of an electronic card is inserted into the inserted groove 101, the rear end of the card can be rotated downwards to get an electronic connection between the connector 100 and the electronic card. The two opposite side portions of the rear end of the card are respectively locked under the locking portion 111. The front end of the card hustles the contacts and make the contacts deform, which will make the contacts give a fore to the card to make the rear end of the card that locked under the locking portions 111 to tilt, and the rear end of the card may push the locking portions to make the latching arms 11 move upwards. At that time, the blocking portion 35 received in the slot 121 and positioned under the blocking arm 122 may be blocked by the blocking arm 122, which will prevent the latching arm 11 from further moving upwards to ensure the locking function. What's more, the blocking portion 35 is separated from the soldering member 4, and has no engagement with the soldering member 4, which will not destroy the joint between the soldering portion 42 and the circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing defining a longitudinal main body with an inserted groove extending along a longitudinal direction, a pair of latching arms extending forwards from two opposite ends of the main body and a pair of sidewalls respectively positioned outside of the latching arms, each sidewall defining a slot therein;

a plurality of contacts received in the main body; and a pair of latching members assembled on the latching arms, each latching member being attached to an outer side of a corresponding latching arm and defining a blocking portion extending into the slot, wherein each latching member defines a retaining portion extending from one side thereof, the retaining portion engages with the latching arm to retain the latching member in the latching arm, each latching arm defines a locking portion projecting from an inner side thereof, and each locking portion defines a top face as a guiding surface, the latching member defines a guiding portion extending from a same side that the retaining portion extending therefrom, and the guiding portion covers on the guiding surface.

2. The electrical connector as described in claim 1, wherein the electrical connector further defines a pair of soldering members each separated from the corresponding latching member, one end of each soldering member is retained in the sidewall and the other end is defined as a soldering portion.

3. The electrical connector as described in claim 1, wherein each blocking portion bends from a lower edge of the latching member.

4. The electrical connector as described in claim 3, wherein the slot runs through a front end and an inner surface of the sidewall.

5. The electrical connector as described in claim 4, wherein the sidewall which is positioned above the slot is defined as a blocking arm, and the blocking arm may prevent the latching arm from further moving outwards.

6. The electrical connector as described in claim 5, wherein a receiving slot is defined between the blocking arm and the corresponding latching arm, and the latching member defines an insertion portion which defining a plurality of barbs thereon, the insertion portion is inserted into the receiving slot with the barbs engaging with the receiving slot.

7. An electrical connector comprising:

an insulative housing defining a longitudinal main body, the main body being provided with an inserted groove extending along a longitudinal direction, and defining a plurality of passages therein, two opposite ends of the main body each projecting forwards and respectively a latching arm and a blocking arm positioned outside of the latching arm;

a plurality of contacts received in the corresponding passages; and a pair of latching members assembled on the latching arms, each latching member being attached to an outer side of a corresponding latching arm and defining a blocking portion extending under the blocking, wherein a sidewall extends forwards from each end of the opposite ends of the mainly body, each sidewall is positioned outside of the latching arm and each defines a slot therein, the sidewall positioned above the slot is defined as the blocking arm, the blocking portion extends into the slot.

8. An electrical connector comprising:

an insulative housing defining an elongated main body, extending along longitudinal direction, with a pair of block arms unitarily formed at two opposite ends thereof and extending in a front-to-back direction perpendicular to said longitudinal direction;

a pair of latching arms unitarily formed with the main body adjacent to the corresponding block arms respectively, each of said latching arms defining a locking portion formed on an inner face of a free end portion thereof; and a pair of reinforcement members attached to the pair of latching arms, respectively, each of said reinforcement members defining a unitarily laterally inwardly extending guiding portion atop the locking portion, and a unitarily laterally outwardly extending blocking portion intimately located under a section of the blocking arm so as to cooperate with the guiding portion to restrict relative movement between the latching arm and the reinforcement member in a vertical direction perpendicular to said longitudinal direction and said front-to-back direction.

9. The electrical connector as claimed in claim 8, wherein said section of the blocking arm includes a slot thereunder and the blocking portion is received in said slot.

* * * * *